US009904193B2

(12) United States Patent
Nakagawa et al.

(10) Patent No.: US 9,904,193 B2
(45) Date of Patent: Feb. 27, 2018

(54) TONER AND METHOD OF PRODUCING TONER

(71) Applicant: CANON KABUSHIKI KAISHA, Tokyo (JP)

(72) Inventors: Yoshihiro Nakagawa, Numazu (JP); Masatake Tanaka, Yokohama (JP); Naoya Isono, Suntou-gun (JP); Harumi Takada, Susono (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/198,858

(22) Filed: Jun. 30, 2016

(65) Prior Publication Data

US 2017/0060011 A1 Mar. 2, 2017

(30) Foreign Application Priority Data

Aug. 28, 2015 (JP) ..... 2015-168488

(51) Int. Cl.
*G03G 9/087* (2006.01)
*G03G 9/08* (2006.01)

(52) U.S. Cl.
CPC ..... *G03G 9/08711* (2013.01); *G03G 9/0806* (2013.01)

(58) Field of Classification Search
CPC ..... G03G 9/08711; G03G 9/08708
See application file for complete search history.

(56) References Cited

U.S. PATENT DOCUMENTS 5,135,833 A * 8/1992 Matsunaga ..... G03G 9/08795 430/108.8
5,389,487 A * 2/1995 Kawakami ..... G03G 9/08711 430/109.3
6,569,589 B2 5/2003 Inaba et al.
7,833,685 B2 11/2010 Tanaka et al.
8,367,289 B2 2/2013 Isono et al.
8,377,616 B2 2/2013 Tani et al.
8,383,307 B2 2/2013 Inoue et al.
8,440,382 B2 5/2013 Isono et al.
8,497,054 B2 7/2013 Sugiyama et al.
8,603,712 B2 12/2013 Aoki et al.
8,628,899 B2 1/2014 Kawamura et al.
8,652,737 B2 2/2014 Handa et al.
8,741,519 B2 6/2014 Watanabe et al.
8,778,581 B2 7/2014 Nonaka et al.
8,815,484 B2 8/2014 Tanaka et al.
8,828,633 B2 9/2014 Itabashi et al.
8,846,284 B2 9/2014 Kinumatsu et al.
9,158,216 B2 10/2015 Shimano et al.
9,377,705 B2 6/2016 Shimano et al.
9,383,668 B2 7/2016 Noji et al.
2005/0137278 A1* 6/2005 Fromm ..... C08F 212/08 522/100
2005/0272851 A1* 12/2005 Agur ..... C08K 5/0008 524/487
2007/0111129 A1* 5/2007 Patel ..... G03G 9/0804 430/108.8
2010/0035171 A1 2/2010 Watanabe et al.
2012/0045717 A1 2/2012 Hiroko et al.
2013/0130170 A1* 5/2013 Watanabe ..... G03G 9/09328 430/109.31
2014/0349232 A1 11/2014 Kinumatsu et al.
2014/0356779 A1 12/2014 Hasegawa et al.
2015/0099222 A1 4/2015 Terui et al.
2015/0153666 A1 6/2015 Isono et al.
2015/0153668 A1 6/2015 Tanaka et al.
2015/0153669 A1 6/2015 Yoshida et al.
2015/0261110 A1 9/2015 Nakagawa et al.
2015/0331344 A1 11/2015 Tominaga et al.
2015/0370189 A1 12/2015 Tanaka et al.

FOREIGN PATENT DOCUMENTS

JP 2005-091707 A 4/2005
JP 2008-020631 A 1/2008
JP 2008-309984 A 12/2008
JP 2010-122667 A 6/2010
JP 2013-228707 A 11/2013
JP 2014-178420 A 9/2014

OTHER PUBLICATIONS

Harasaki, Yuji, "Basic Science of Coating", p. 54-57 (1988) (Maki Shoten).
U.S. Appl. No. 15/152,313, filed May 11, 2016, Masatake Tanaka.
U.S. Appl. No. 15/154,802, filed May 13, 2016, Masatake Tanaka.

* cited by examiner

*Primary Examiner* — Hoa V Le
(74) *Attorney, Agent, or Firm* — Fitzpatrick Cella Harper and Scinto

(57) ABSTRACT

Provided is a toner, including a toner particle containing: a binder resin containing a styrene acrylic resin as a main component, a colorant, a hydrocarbon wax, and a wax dispersant, in which: the wax dispersant includes a polymer of a vinyl resin component and a hydrocarbon compound, the vinyl resin component including styrene and one or more kinds of vinyl-based polymerizable monomers except a styrene derivative; and a solubility parameter of the binder resin (A) a solubility parameter of the vinyl resin segment of the wax dispersant (C), and a solubility parameter of the hydrocarbon compound segment of the wax dispersant (D) satisfy the formulae (1) and (2).

$$|A-C| \leq 0.20 \quad (1)$$

$$C-D < 1.65 \quad (2)$$

9 Claims, No Drawings

TONER AND METHOD OF PRODUCING TONER

BACKGROUND OF THE INVENTION

Field of the Invention

The present invention relates to a toner to be used for developing an electrostatic latent image formed by a method, such as an electrophotographic method, an electrostatic recording method, or a toner jet system recoding method, for forming a toner image, and a method of producing the toner.

Description of the Related Art

In recent years, in a copying machine, a printer, or a facsimile, energy saving has been considered as a large technical problem, and hence a significant reduction in quantity of heat to be applied to an image-fixing apparatus has been desired. Therefore, in a toner, there has been a growing need for the so-called "low-temperature fixability" by which an image can be fixed at lower energy.

A method of improving the low-temperature fixability of the toner is, for example, a method involving reducing the glass transition temperature (Tg) of a binder resin to be used. However, when the Tg of the binder resin is merely reduced, the releasability of the toner at low temperature becomes insufficient, and hence a cold offset to a fixing member occurs before the reduction in Tg exhibits a reducing effect on the viscosity of the binder resin. The speed of the exudation of a release agent to the surface of the toner at the time of its fixation needs to be increased for suppressing the cold offset. However, when an attempt is made to achieve the increase through the use of a release agent having a lower melting point, simultaneously with the increase in speed of the exudation at the time of the fixation, the exudation of the release agent to the surface of the toner is liable to occur during its storage as well, and hence it becomes difficult to achieve both the low-temperature fixability and heat-resistant storage stability of the toner.

In view of the foregoing, in order that such detrimental effects of the release agent (wax) as described above may be suppressed, an attempt has been made to improve the ease of exudation of the release agent through the control of its state of dispersion in the toner without any reduction in melting point of the release agent.

In Japanese Patent Application Laid-Open No. 2013-228707, there is a proposal of a method involving using a wax dispersant for improving the dispersibility of a hydrocarbon wax in a polyester binder resin.

In Japanese Patent Application Laid-Open No. 2010-122667, there is a proposal of a method involving dispersing a wax in a polyester binder resin through the use of a wax dispersant in a dissolution suspension method in which toner production is performed with an aqueous medium.

In Japanese Patent Application Laid-Open No. 2005-91707, there is a proposal of a method involving dispersing a wax in a toner using a styrene/acryl based resin as a binder resin in an emulsion aggregation method serving as a method in which toner production is performed in an aqueous medium.

The hydrocarbon wax in Japanese Patent Application Laid-Open No. 2013-228707 is improved in dispersibility by using a wax dispersant having small compatibility with a polyester for the wax. However, when the wax dispersant of Japanese Patent Application Laid-Open No. 2013-228707 is used as a wax dispersant for dispersing a wax in a binder resin containing a styrene acrylic resin as a main component, the dispersibility of the wax is susceptible to improvement.

In addition, the method is applicable to toner production by the so-called pulverization method in which toner raw materials are kneaded and then pulverized to provide toner particles. Accordingly, the dispersibility of the wax at the time of the production of a toner by a method such as the dissolution suspension method or a suspension polymerization method needs to be improved.

In Japanese Patent Application Laid-Open No. 2010-122667, there is a disclosure of a wax dispersant effective when a polyester resin is used as a binder resin, and the dispersant is found to be susceptible to improvement in order that a wax may be dispersed in a binder resin containing a styrene acrylic resin as a main component.

It cannot be said that the affinity of the wax dispersant disclosed in Japanese Patent Application Laid-Open No. 2005-91707 for the styrene/acryl based binder resin is sufficient, and hence the wax dispersant is susceptible to further improvement in terms of the dispersibility of a wax. In addition, in Japanese Patent Application Laid-Open No. 2005-91707, there is a disclosure that a toner is produced by the emulsion aggregation method, but the method differs from the dissolution suspension method or the suspension polymerization method in method for the introduction of a wax. Therefore, the dispersant is susceptible to improvement in order that the dispersibility of the wax in a binder resin containing a styrene acrylic resin as a main component may be improved without any dependence on a toner production method.

As described above, a method of obtaining a toner in which a wax has a state of dispersion enough to improve low-temperature fixability through the use of a binder resin containing a styrene acrylic resin as a main component has not been proposed yet.

SUMMARY OF THE INVENTION

The present invention provides a toner that has solved the conventional problems. That is, an object of the present invention is to provide a toner having the following features and a method of producing the toner. The dispersibility of a wax in the toner is satisfactory even when a binder resin containing a styrene acrylic resin as a main component is used, and the toner is excellent in releasability at the time of low-temperature fixation and is significantly suppressed in occurrence of a cold offset.

The present invention relates to a toner, including a toner particle containing:

a binder resin containing a styrene acrylic resin as a main component;

a colorant;

a hydrocarbon wax; and a wax dispersant, in which:

the wax dispersant includes a vinyl resin segment and a hydrocarbon compound segment, the vinyl resin segment including a styrene monomer and one or more kinds of vinyl-based polymerizable monomers except the styrene monomer; and the binder resin and the wax dispersant satisfy the following formulae (1) and (2):

$$|A-C| \leq 0.20 \quad (1)$$

$$C-D < 1.65 \quad (2)$$

in the formulae (1) and (2):

"A" represents a solubility parameter of the binder resin;

"C" represents a solubility parameter of the vinyl resin segment of the wax dispersant; and "D" represents a solubility parameter of the hydrocarbon compound segment of the wax dispersant.

The present invention also relates to a method of producing the toner including the toner particle having the above-mentioned structure, the method including:

forming, in an aqueous medium, a particle of a polymerizable monomer composition containing a polymerizable monomer, the colorant, the hydrocarbon wax, and the wax dispersant; and polymerizing the polymerizable monomer in the particle of the polymerizable monomer composition to produce the binder resin containing the styrene acrylic resin as a main component.

The present invention also relates to a method of producing the toner including the toner particle having the above-mentioned structure, the method including:

forming, in an aqueous medium, a particle of a resin solution obtained by dissolving or dispersing the binder resin containing the styrene acrylic resin as a main component, the colorant, the hydrocarbon wax, and the wax dispersant in an organic solvent; and removing the organic solvent in the particle of the resin solution.

Further features of the present invention will become apparent from the following description of exemplary embodiments.

DESCRIPTION OF THE EMBODIMENTS

Preferred embodiments of the present invention will now be described in detail.

The inventors of the present invention have used a wax dispersant having a vinyl resin segment and a hydrocarbon compound segment at the time of the dispersion of a hydrocarbon wax in a binder resin containing a styrene acrylic resin as a main component. Further, the inventors have set each of the solubility parameters of the binder resin, the vinyl resin segment of the wax dispersant, and the hydrocarbon compound segment of the wax dispersant to a specific range. As a result, the inventors have found that the dispersibility of the wax in the toner is drastically improved, and as a result, the releasability of the toner at the time of low-temperature fixation is improved.

The state of dispersion of the wax in the toner can be identified by observing a section of a toner particle with a transmission electron microscope. According to the present invention, the vinyl resin segment serving as a binder resin-philic segment in the wax dispersant and the hydrocarbon compound segment serving as a wax-philic segment therein are optimized for the binder resin containing the styrene acrylic resin as a main component and the hydrocarbon wax, respectively. The inventors have assumed that as a result of the foregoing, the dispersibility of the wax is improved and the ease of exudation of the wax to the surface of the toner particle at the time of fixation is improved, and hence the releasability at the time of the low-temperature fixation is improved.

A production method of the present invention is specifically described below, but the present invention is not limited thereto.

The present invention is applicable to all toner production methods each involving using a binder resin containing a styrene acrylic resin as a main component. When the present invention is applied to a wet production method involving granulating toner raw materials in an aqueous medium to produce toner particles out of those methods, its effects are significantly obtained. Each step of, for example, a production method based on a suspension polymerization method involving granulating a composition containing a polymerizable monomer in an aqueous medium to produce toner particles is described.

In the present invention, the phrase "containing a styrene acrylic resin as a main component" means that the content of the styrene acrylic resin in the binder resin is 50 mass % or more.

(Polymerizable Monomer Composition Preparation Step)

A polymerizable monomer, a hydrocarbon wax, a wax dispersant, a colorant, and the like are mixed to prepare a polymerizable monomer composition. The colorant may be mixed with any other composition after having been dispersed in the polymerizable monomer or an organic solvent in advance with a medium stirring mill or the like, or may be dispersed after all other compositions have been mixed. A polar resin, a pigment dispersant, a charge control agent, or the like can be appropriately added to the polymerizable monomer composition as required.

(Granulation Step)

An aqueous dispersion medium containing a dispersion stabilizer is prepared and loaded into a stirring tank having installed therein a stirring machine having a high shearing force. The polymerizable monomer composition is added to the medium, and the mixture is stirred to disperse the composition. Thus, a polymerizable monomer composition dispersion liquid is obtained. It is important that the dispersion liquid droplet diameters (particle diameters) of the polymerizable monomer composition be uniformized because the distribution of the dispersion liquid droplet diameters of the polymerizable monomer composition is directly reflected in the particle diameter distribution of toner particles to be obtained.

(Polymerization Step)

The polymerizable monomer composition dispersion liquid obtained as described above is introduced into a polymerization step to produce a binder resin containing a styrene acrylic resin as a main component. Thus, a resin particle dispersion liquid is obtained. A general stirring tank whose temperature can be regulated can be used in the polymerization step in the present invention.

The polymerization is performed at a temperature of 40° C. or more, or generally of 50° C. or more and 90° C. or less. Although the polymerization temperature may be constant from beginning to end, the temperature may be increased in the latter half of the polymerization step for the purpose of obtaining a desired molecular weight distribution. Any stirring blade may be used as a stirring blade to be used in stirring as long as the stirring blade can suspend the resin particle dispersion liquid without causing the liquid to stay, and can keep a temperature in the tank uniform.

(Volatile Component Removal Step)

A volatile component removal step may be performed for removing an unreacted polymerizable monomer or the like from the resin particle dispersion liquid after the completion of the polymerization step. The volatile component removal step is performed by heating and stirring the resin particle dispersion liquid in a stirring tank having installed therein a stirring unit. A heating condition at the time of the volatile component removal step is appropriately regulated in consideration of the vapor pressure of a component that is to be removed, such as the polymerizable monomer. The volatile component removal step can be performed under normal pressure or reduced pressure.

(Solid-liquid Separation Step, Washing Step, and Drying Step)

A toner particle dispersion liquid is treated with an acid or an alkali for the purpose of removing the dispersion stabilizer adhering to the surface of a toner particle. After the dispersion stabilizer has been removed from the toner particle, the toner particle is separated from the aqueous medium by a general solid-liquid separation method. In order to completely remove the acid or the alkali, and the dispersion stabilizer component dissolved in the acid or the alkali, the toner particle is preferably washed by adding water again. Sufficient washing is performed by repeating the washing step several times, followed by solid-liquid separation again. Thus, toner particles are obtained. The resultant toner particles may be dried with a known drying unit as required.

(Classification Step)

When a sharper particle size distribution is required, a particle deviating from a desired particle size distribution can be separated and removed by subjecting the toner particles thus obtained to a classification step with an air classifier or the like.

In addition, the present invention is applicable to a dissolution suspension method involving granulating, in an aqueous medium, a dissolved liquid containing, for example, a binder resin dissolved in an organic solvent to produce toner particles. Each step of an example of a production method based on the dissolution suspension method is described.

(Resin Solution Preparation Step)

A resin solution is prepared by adding a binder resin containing a styrene acrylic resin as a main component, a colorant, a hydrocarbon wax, a wax dispersant, and the like to an organic solvent. A dispersing machine, such as a homogenizer, a ball mill, a colloid mill, or an ultrasonic dispersing machine, may be used for the purpose of improving the dispersibility of the colorant. In addition, a product obtained by dispersing a pigment in the organic solvent in advance with any such dispersing machine may be used. A release agent except the hydrocarbon wax, a polar resin, a pigment dispersant, a charge control agent, or the like can be appropriately added to the resin solution as required.

(Granulation Step)

Next, the resin solution is loaded into an aqueous medium containing a dispersion stabilizer, and granulation is performed by suspending the solution with a high-speed stirring machine or a high-shearing force dispersing machine, such as an ultrasonic dispersing machine. Thus, a resin composition dispersion liquid is obtained.

(Organic Solvent Removal Step)

Next, resin particles are obtained by precipitating a resin in the resin composition through the evaporation and removal of the organic solvent in the resin composition dispersion liquid. Thus, a resin particle dispersion liquid is obtained. Conditions for the organic solvent removal step are the same as the conditions for the volatile component removal step in the toner production method based on the suspension polymerization method.

(Solid-liquid Separation Step, Washing Step, Drying Step, and Classification Step)

The resultant resin particle dispersion liquid can be subjected to a solid-liquid separation step, a washing step, a drying step, and a classification step under the same conditions as those in the toner production method based on the suspension polymerization method.

Next, exemplary materials that can be used in the method of producing a toner particle of the present invention are specifically described, but the present invention is not limited to the following.

A vinyl-based polymerizable monomer capable of radical polymerization can be used as a polymerizable monomer constituting the styrene-acrylic resin. A monofunctional polymerizable monomer or a polyfunctional polymerizable monomer can be used as the vinyl-based polymerizable monomer.

Examples of the monofunctional polymerizable monomers include: styrene and styrene derivatives, such as α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, and p-phenylstyrene; acrylic polymerizable monomers, such as methyl acrylate, ethyl acrylate, n-propyl acrylate, iso-propyl acrylate, n-butyl acrylate, iso-butyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethyl phosphate ethyl acrylate, diethyl phosphate ethyl acrylate, dibutyl phosphate ethyl acrylate, and 2-benzoyloxy ethyl acrylate; and methacrylic polymerizable monomers, such as methyl methacrylate, ethyl methacrylate, n-propyl methacrylate, iso-propyl methacrylate, n-butyl methacrylate, iso-butyl methacrylate, tert-butyl methacrylate, n-amyl methacrylate, n-hexyl methacrylate, 2-ethylhexyl methacrylate, n-octyl methacrylate, n-nonyl methacrylate, diethyl phosphate ethyl methacrylate, and dibutyl phosphate ethyl methacrylate.

Examples of the polyfunctional polymerizable monomers include diethylene glycol diacrylate, triethylene glycol diacrylate, tetraethylene glycol diacrylate, polyethylene glycol diacrylate, 1,6-hexanediol diacrylate, neopentyl glycol diacrylate, tripropylene glycol diacrylate, polypropylene glycol diacrylate, 2,2'-bis(4-(acryloxydiethoxy)phenyl)propane, trimethylolpropane triacrylate, tetramethylolmethane tetraacrylate, ethylene glycol dimethacrylate, diethylene glycol dimethacrylate, triethylene glycol dimethacrylate, tetraethylene glycol dimethacrylate, polyethylene glycol dimethacrylate, 1,3-butylene glycol dimethacrylate, 1,6-hexanediol dimethacrylate, neopentyl glycol dimethacrylate, polypropylene glycol dimethacrylate, 2,2'-bis(4-(methacryloxydiethoxy)phenyl)propane, 2,2'-bis(4-(methacryloxypolyethoxy)phenyl)propane, trimethylolpropane trimethacrylate, tetramethylolmethane tetramethacrylate, divinylbenzene, divinylnaphthalene, and divinyl ether.

One kind of the monofunctional polymerizable monomers is used alone, or two or more kinds thereof are used in combination. Alternatively, the monofunctional polymerizable monomer and the polyfunctional polymerizable monomer are used in combination. Alternatively, one kind of the polyfunctional polymerizable monomers is used alone, or two or more kinds thereof are used in combination. Of the polymerizable monomers, the following monomers are preferably used from the viewpoints of the developing characteristic and durability of the toner: one kind of styrene and the styrene derivatives is used alone, or two or more kinds thereof are mixed, or such monomer or monomer mixture is mixed with any other polymerizable monomer.

A polar resin may be added to the toner of the present invention. A polyester-based resin or a carboxyl group-containing styrene-based resin is preferred as the polar resin. In the case where the polyester-based resin or the carboxyl group-containing styrene-based resin is used as the polar resin, the lubricity of the resin itself can be expected when the resin is unevenly distributed to the surface of the toner particle to form the shell.

A condensation polymerization product of an alcohol monomer and a carboxylic acid monomer is used as the polyester-based resin. Examples of the alcohol monomer include the following.

Alkyleneoxide adducts of bisphenol A, such as polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene(2.0)-2,2-bis(4-hydroxyphenyl)propane, and polyoxypropylene(6.0)-2,2-bis(4-hydroxyphenyl)propane; ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A, hydrogenated bisphenol A, sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

Meanwhile, examples of the carboxylic acid monomer include the following.

Aromatic dicarboxylic acids, such as phthalic acid, isophthalic acid, and terephthalic acid, or anhydrides thereof; alkyl dicarboxylic acids, such as succinic acid, adipic acid, sebacic acid, and azelaic acid, or anhydrides thereof; succinic acid substituted with an alkyl group or alkenyl group having 6 to 18 carbon atoms or an anhydride thereof; and unsaturated dicarboxylic acids, such as fumaric acid, maleic acid, and citraconic acid, or anhydrides thereof.

In addition, the following monomers may be used in addition to the monomers described above.

Polyhydric alcohols, such as glycerin, sorbit, sorbitan, and in addition, for example, an oxyalkylene ether of a novolac-type phenol resin; and polyvalent carboxylic acids, such as trimellitic acid, pyromellitic acid, benzophenone tetracarboxylic acid, and anhydrides thereof.

Of those, in particular, it is preferred to use a resin obtained by condensation polymerization of polyester unit components, including: a bisphenol derivative represented by the following formula (4) serving as a dihydric alcohol monomer component; and a carboxylic acid component including a divalent or higher valent carboxylic acid (for example, fumaric acid, maleic acid, maleic acid anhydride, phthalic acid, terephthalic acid, trimellitic acid, or pyromellitic acid) or an acid anhydride thereof, or a lower alkyl ester thereof serving as an acid monomer component, because the resin has a satisfactory charge characteristic.

(4)

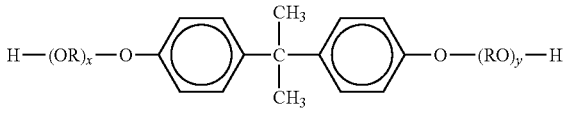

(In the formula, each R independently represents an ethylene group or a propylene group, x and y each represent an integer of 1 or more, and the average value of x+y is from 2 to 10.)

The carboxyl group-containing styrene-based resin is preferably, for example, a styrene-based acrylic acid copolymer, a styrene-based methacrylic acid copolymer, or a styrene-based maleic acid copolymer. Of those, a styrene-acrylate-acrylic acid-based copolymer is particularly preferred because its charge quantity is easily controlled. In addition, the carboxyl group-containing styrene-based resin more preferably contains a monomer having a primary alcohol moiety or secondary alcohol moiety. Specific examples of the polymer composition can include a styrene-2-hydroxyethyl methacrylate-methacrylic acid-methyl methacrylate copolymer, a styrene-n-butyl acrylate-2-hydroxyethyl methacrylate-methacrylic acid-methyl methacrylate copolymer, and a styrene-α-methylstyrene-2-hydroxyethyl methacrylate-methacrylic acid-methyl methacrylate copolymer. The resin containing the monomer having a primary alcohol moiety or secondary alcohol moiety has large polarity and more satisfactory long-term standing stability.

The content of the polar resin is preferably 1.0 part by mass or more and 20.0 parts by mass or less, more preferably 2.0 parts by mass or more and 10.0 parts by mass or less with respect to 100 parts by mass of the binder resin.

The toner of the present invention contains a colorant, and known colorants, such as various dyes and pigments that have heretofore been known, can each be used as the colorant.

Carbon black, a magnetic material, or a colorant toned to a black color with a yellow, magenta, or cyan colorant described below is utilized as a black colorant.

Examples of the yellow colorant include a monoazo compound, a disazo compound, a condensed azo compound, an isoindolinone compound, an anthraquinone compound, an azo metal complex methine compound, and an arylamide compound. A specific example thereof is C.I. Pigment Yellow 74, 93, 95, 109, 111, 128, 155, 174, 180, or 185.

As the magenta colorant, for example, a monoazo compound, a condensed azo compound, a diketopyrrolopyrrole compound, an anthraquinone compound, a quinacridone compound, a basic dye lake compound, a naphthol compound, a benzimidazolone compound, a thioindigo compound, or a perylene compound is used. Specific examples thereof can include C.I. Pigment Red 2, 3, 5, 6, 7, 23, 48:2, 48:3, 48:4, 57:1, 81:1, 122, 144, 146, 150, 166, 169, 177, 184, 185, 202, 206, 220, 221, 238, 254, or 269 and C.I. Pigment Violet 19.

As the cyan colorant, for example, a copper phthalocyanine compound and a derivative thereof, an anthraquinone compound, or a basic dye lake compound is available. A specific example thereof is C.I. Pigment Blue 1, 7, 15, 15:1, 15:2, 15:3, 15:4, 60, 62, or 66.

In the case where the toner of the present invention is used as a magnetic toner, a magnetic material only needs to be incorporated into a toner particle thereof. In this case, the magnetic material can also serve as a colorant. In the present invention, examples of the magnetic material include: iron oxides, such as magnetite, hematite, and ferrite; and metals, such as iron, cobalt, and nickel. The examples further include an alloy of any such metal and a metal such as aluminum, cobalt, copper, lead, magnesium, tin, zinc, antimony, beryllium, bismuth, cadmium, calcium, manganese, selenium, titanium, tungsten, or vanadium, and a mixture of the metals.

The colorant to be used in the present invention is selected in terms of a hue angle, chroma, lightness, light fastness, OHP transparency, and dispersibility in the toner particle. One kind of those colorants can be used alone, or two or more kinds thereof can be used as a mixture or in the state of a solid solution. The colorant is preferably used in an amount of 1.0 part by mass or more and 20.0 parts by mass or less with respect to 100 parts by mass of the binder resin.

Examples of the hydrocarbon wax to be used in the present invention include: aliphatic hydrocarbon-based waxes, such as a low-molecular weight polyethylene, a low-molecular weight polypropylene, a microcrystalline wax, a paraffin wax, and a Fischer-Tropsch wax; oxides of aliphatic hydrocarbon-based waxes, such as an oxidized polyethylene wax, or block copolymers thereof; and waxes each obtained by grafting an aliphatic hydrocarbon-based wax with a vinyl-based monomer, such as styrene or acrylic acid.

The hydrocarbon wax is preferably used in an amount of 1.0 part by mass or more and 30.0 parts by mass or less with respect to 100 parts by mass of the binder resin. The melting point of the hydrocarbon wax to be used in the present invention preferably falls within the range of from 30° C. or more to 130° C. or less, and more preferably falls within the range of from 60° C. or more to 100° C. or less. When a wax showing such heat characteristic as described above is used, not only satisfactory fixability of the toner to be obtained but also a releasing effect by the wax is efficiently expressed, and hence a sufficient fixation region is secured.

A wax dispersant to be used in the present invention has a vinyl resin segment, which is a polymer of a composition containing a styrene monomer and one or more kinds of vinyl-based polymerizable monomers except the styrene monomer, and a hydrocarbon compound segment. That is, the wax dispersant has a structure in which the vinyl resin segment, which is the polymer of the composition containing the styrene monomer and the one or more kinds of vinyl-based polymerizable monomers except the styrene monomer, and the hydrocarbon compound segment react with each other. For example, acrylic polymerizable monomers, such as methyl acrylate, ethyl acrylate, n-propyl acrylate, iso-propyl acrylate, n-butyl acrylate, iso-butyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, and acrylonitrile, and methacrylic polymerizable monomers, such as methyl methacrylate, ethyl methacrylate, n-propyl methacrylate, iso-propyl methacrylate, n-butyl methacrylate, iso-butyl methacrylate, tert-butyl methacrylate, n-amyl methacrylate, n-hexyl methacrylate, 2-ethylhexyl methacrylate, n-octyl methacrylate, and n-nonyl methacrylate, can each be used as the vinyl-based polymerizable monomer except the styrene monomer.

The content of acrylonitrile in the vinyl resin segment is preferably as small as possible from the viewpoint of improving the ease with which the formula (1) of the present invention ($|A-C|\leq 0.20$) is controlled, and is specifically 5 mass % or less. It is more preferred that the content be 3 mass % or less, and it is particularly preferred that the vinyl resin segment be free of acrylonitrile in itself.

For example, polyolefins, such as a low-molecular weight polyethylene and a low-molecular weight polypropylene, linear aliphatic hydrocarbon compounds, such as a paraffin wax and a Fischer-Tropsch wax, and synthetic waxes, such as a microcrystalline wax, can each be used as the hydrocarbon compound segment of the wax dispersant. The hydrocarbon wax is used in the toner particle, and a hydrocarbon compound is used as a wax-philic segment for improving an affinity for the wax. In addition, the hydrocarbon compound segment is more preferably of the same kind as that of the hydrocarbon wax from the viewpoint of the affinity.

Each polymerizable monomer to be used in the vinyl resin segment of the wax dispersant needs to satisfy a relationship of $|A-C|\leq 0.20$ where represents the solubility parameter value (hereinafter referred to as "SP value") of the binder resin and "C" represents the SP value of the vinyl resin segment. When $|A-C|>0.20$, an affinity between the binder resin and the wax dispersant reduces, and hence the effect of the wax dispersant reduces. The SP value of the vinyl resin segment can be appropriately adjusted in accordance with the composition of each vinyl-based polymerizable monomer. It is assumed that when the binder resin and the vinyl resin segment are set to be identical to each other in composition, the $|A-C|$ becomes minimum and hence the affinity becomes maximum.

The hydrocarbon compound segment of the wax dispersant preferably satisfies a relationship of $|B-D|\leq 0.30$ where represents the SP value of the hydrocarbon wax and "D" represents the SP value of the hydrocarbon compound segment. When the range is satisfied, an affinity between the hydrocarbon wax and the wax dispersant is improved, and hence the effect of the wax dispersant is sufficiently obtained. Although "D", represents the SP value of the hydrocarbon compound segment varies in accordance with the hydrocarbon compound segment to be used in the wax dispersant, it is assumed that when the segment is of the same kind as that of the hydrocarbon wax to be used in the toner, the $|B-D|$ becomes minimum and hence the affinity is further improved.

In addition, when the styrene acrylic resin is used as the binder resin like the present invention, the SP value "C" of the vinyl resin segment of the wax dispersant and the SP value "D" of the hydrocarbon compound segment thereof need to satisfy a relationship of $C-D<1.65$. When $C-D\geq 1.65$, it becomes difficult to achieve both the affinities of the wax dispersant for the binder resin and the hydrocarbon wax, and as a result, the effect of the wax dispersant reduces. A value for the C−D can be appropriately adjusted through the selection of: the composition of each vinyl-based polymerizable monomer to be used in the vinyl resin segment; and the hydrocarbon compound segment.

The amount of the hydrocarbon compound segment of the wax dispersant is preferably 1 mass % or more and 50 mass % or less of the total mass of the wax dispersant. The case where the amount of the hydrocarbon compound segment falls within the range is preferred because the affinity between the wax and the wax dispersant is suppressed from becoming excessively small.

A content Wb mass % of the wax dispersant in the toner and a content Wa mass % of the wax in the toner preferably satisfy a relationship of $0.1\leq Wb/Wa\leq 2.0$. The case where the Wb/Wa falls within the range is preferred because the stability of the state of dispersion of the wax in the toner is maintained, and the dispersibility of the wax becomes sufficient.

In addition, the toner particle of the present invention may use a charge control agent. Of such charge control agents, a charge control agent that controls the toner particle so that the particle may be negatively chargeable is preferably used. Examples of the charge control agent include the following.

There are given an organic metal compound, a chelate compound, a monoazo metal compound, an acetylacetone metal compound, a urea derivative, a metal-containing salicylic acid-based compound, a metal-containing naphthoic acid-based compound, a quaternary ammonium salt, Calixarene, a silicon compound, a non-metal carboxylic acid-based compound, and derivatives thereof. In addition, a sulfonic acid resin having a sulfonic acid group, a sulfonic acid salt group, or a sulfonate group can be preferably used. The addition amount of the charge control agent is preferably 0.01 part by mass or more and 20.0 parts by mass or less, more preferably 0.5 part by mass or more and 10.0 parts by mass or less with respect to 100 parts by mass of the binder resin.

The organic solvent to be used in the resin solution in the dissolution suspension method is not particularly limited as long as the solvent is compatible with materials serving as raw materials for the toner particle, such as the binder resin and the wax. However, an organic solvent having a certain vapor pressure even at a temperature equal to or less than the boiling point of water is preferred from the viewpoint of the removal of the solvent. For example, toluene, xylene, ethyl acetate, butyl acetate, methyl ethyl ketone, or methyl isobutyl ketone can be used.

In addition, a known surfactant, organic dispersant, or inorganic dispersant can be used as the dispersion stabilizer to be added to the aqueous medium. Of those, an inorganic dispersant can be suitably used because its stability is hardly broken even by a polymerization temperature and a lapse of time, and the dispersant is easily washed off and hardly has an adverse effect on the toner. Examples of the inorganic dispersant include the following: polyvalent metal phosphates, such as tricalcium phosphate, magnesium phosphate, aluminum phosphate, and zinc phosphate; inorganic salts including carbonates, such as calcium carbonate and magnesium carbonate, calcium metasilicate, calcium sulfate, and barium sulfate; and inorganic oxides, such as calcium hydroxide, magnesium hydroxide, aluminum hydroxide, silica, bentonite, and alumina. Those inorganic dispersants can be almost completely removed by adding an acid or an alkali to dissolve the dispersants after the completion of the polymerization.

Methods of calculating and measuring respective physical property values specified in the present invention are described below.

<Method of Calculating Solubility Parameter (SP Value)>

A SP value in the present invention was determined by using Fedors' formula (5). Values for Δei and Δvi in the formula were determined with reference to "Evaporation Energies and Molar Volumes (25° C.) of Atoms and Atomic Groups" shown in Tables 3 to 9 of "Basic Science of Coating" by Yuji Harasaki, p. 54-57, 1988 (Maki Shoten).

$$\delta i=(Ev/V)^{1/2}=(\Delta ei/\Delta vi)^{1/2} \quad (5)$$

Ev: evaporation energy

V: molar volume

Δei: evaporation energy of an atom or an atomic group of i component

Δvi: molar volume of an atom or an atomic group of i component

<Method of Measuring Molecular Weight>

The peak top molecular weight (Mp) of the wax dispersant is measured by gel permeation chromatography (GPC) as described below.

First, the wax dispersant is dissolved in tetrahydrofuran (THF) at room temperature. Then, the resultant solution is filtered with a solvent-resistant membrane filter "MyShoriDisk" (manufactured by Tosoh Corporation) having a pore diameter of 0.2 μm to provide a sample solution. The concentration of a THF-soluble component in the sample solution is adjusted to 0.8 mass %. Measurement is performed with the sample solution under the following conditions.

Apparatus: high-speed GPC apparatus "HLC-8220 GPC" [manufactured by Tosoh Corporation]

Column: twin of LF-604 [manufactured by Showa Denko K.K.]

Eluent: THF

Flow rate: 0.6 ml/min

Oven temperature: 40° C.

Sample injection amount: 0.020 ml

In the calculation of the molecular weight of a sample, a molecular weight calibration curve prepared with standard polystyrene resins (such as product names "TSK standard polystyrenes F-850, F-450, F-288, F-128, F-80, F-40, F-20, F-10, F-4, F-2, F-1, A-5000, A-2500, A-1000, and A-500" manufactured by Tosoh Corporation) is used.

<Measurement of Content of Hydrocarbon Compound Segment of Wax Dispersant>

A ratio between the hydrocarbon compound segment and the vinyl resin segment in the wax dispersant was measured by using nuclear magnetic resonance spectroscopy ($^1$H-NMR) [400 MHz, $CDCl_3$, room temperature (25° C.)].

Measuring apparatus: FT NMR apparatus JNM-EX400 (manufactured by JEOL Ltd.)

Measuring frequency: 400 MHz

Pulse condition: 5.0 μs

Frequency range: 10,500 Hz

Number of scans: 64 times

A mass ratio between the hydrocarbon compound segment and the vinyl resin segment was determined from the integrated value of the resultant spectrum, and the content of the segment derived from the hydrocarbon compound of the wax dispersant was calculated from the ratio.

<Methods of Measuring Weight-average Particle Diameter (D4) and Number-average Particle Diameter (D1)>

The weight-average particle diameter (D4) and number-average particle diameter (D1) of the toner particles are calculated as described below. A precision particle size distribution measuring apparatus based on a pore electrical resistance method with a 100-micrometer aperture tube "Coulter Counter Multisizer 3" (trademark, manufactured by Beckman Coulter, Inc.) is used as a measuring apparatus. Dedicated software included therewith "Beckman Coulter Multisizer 3 Version 3.51" (manufactured by Beckman Coulter, Inc.) is used for setting measurement conditions and analyzing measurement data. The measurement is performed with the number of effective measurement channels of 25,000.

An electrolyte aqueous solution prepared by dissolving reagent grade sodium chloride in ion-exchanged water so as to have a concentration of 1 mass %, for example, "ISOTON II" (manufactured by Beckman Coulter, Inc.) can be used in the measurement.

The dedicated software is set as described below prior to the measurement and the analysis.

In the "Change Standard Operating Method (SOM)" screen of the dedicated software, the total count number of a control mode is set to 50,000 particles, the number of times of measurement is set to 1, and a value obtained by using "standard particles each having a particle diameter of 10.0 μm" (manufactured by Beckman Coulter, Inc.) is set as a Kd value. A threshold and a noise level are automatically set by pressing a "Threshold/Measure Noise Level button". In addition, a current is set to 1,600 μA, a gain is set to 2, and an electrolyte solution is set to ISOTON II, and a check mark is placed in a check box "Flush Aperture Tube after Each Run."

In the "Convert Pulses to Size Settings" screen of the dedicated software, a bin spacing is set to a logarithmic particle diameter, the number of particle diameter bins is set to 256, and a particle diameter range is set to the range of from 2 μm to 60 μm.

A specific measurement method is as described below.

(1) About 200 ml of the electrolyte aqueous solution is charged into a 250-milliliter round-bottom beaker made of glass dedicated for Multisizer 3. The beaker is set in a sample stand, and the electrolyte aqueous solution in the beaker is stirred with a stirrer rod at 24 rotations/sec in a counterclockwise direction. Then, dirt and bubbles in the aperture tube are removed by the "Flush Aperture" function of the dedicated software.

(2) About 30 ml of the electrolyte aqueous solution is charged into a 100-milliliter flat-bottom beaker made of glass. About 0.3 ml of a diluted solution prepared by diluting "Contaminon N" (10 mass % aqueous solution of a neutral detergent for washing a precision measuring device formed of a nonionic surfactant, an anionic surfactant, and an organic builder and having a pH of 7, manufactured by Wako Pure Chemical Industries, Ltd.) with ion-exchanged water by three parts by mass fold is added as a dispersant to the electrolyte aqueous solution.

(3) An ultrasonic dispersing unit "Ultrasonic Dispersion System Tetora 150" (manufactured by Nikkaki Bios Co., Ltd.) in which two oscillators each having an oscillatory frequency of 50 kHz are built so as to be out of phase by 180° and which has an electrical output of 120 W is prepared. 3.3 l of ion-exchanged water is charged into the water tank of the ultrasonic dispersing unit. About 2 ml of the Contaminon N is charged into the water tank.

(4) The beaker in the section (2) is set in the beaker fixing hole of the ultrasonic dispersing unit, and the ultrasonic dispersing unit is operated. Then, the height position of the beaker is adjusted in order that the liquid level of the electrolyte aqueous solution in the beaker may resonate with an ultrasonic wave from the ultrasonic dispersing unit to the fullest extent possible.

(5) About 10 mg of the toner particles are gradually added to and dispersed in the electrolyte aqueous solution in the beaker in the section (4) under a state in which the electrolyte aqueous solution is irradiated with the ultrasonic wave. Then, the ultrasonic dispersion treatment is continued for an additional 60 seconds. The temperature of water in the water tank is appropriately adjusted so as to be 10° C. or more and 40° C. or less upon ultrasonic dispersion.

(6) The electrolyte aqueous solution in the section (5) in which the toner particles have been dispersed is dropped with a pipette to the round-bottom beaker in the section (1) placed in the sample stand, and the concentration of the toner particles to be measured is adjusted to 5 volume %. Then, measurement is performed until the particle diameters of 50,000 particles are measured.

(7) The measurement data is analyzed with the dedicated software included with the apparatus, and the weight-average particle diameter (D4) and the number-average particle diameter (D1) are calculated. The "Average Diameter" on the "Analysis/Volume Statistics (Arithmetic Average)" screen of the dedicated software when the dedicated software is set to show a graph in a vol % unit is the weight-average particle diameter (D4. In addition, the "Average Diameter" on the "Analysis/Number Statistics (Arithmetic Average)" screen of the dedicated software when the dedicated software is set to show a graph in a number % unit is the number-average particle diameter (D1).

The present invention is specifically described below by way of Examples. However, the present invention is not limited to these examples. All the terms "part(s)" used in Examples mean "part(s) by mass."

<Production of Wax Dispersant 1>

600.0 Parts of xylene and 240.0 parts of a Fischer-Tropsch wax having a melting point of 77° C. were loaded into a reaction vessel with a stirring machine, a temperature gauge, a nitrogen-introducing tube, and a decompression apparatus, and the wax was sufficiently dissolved in xylene, followed by purging with nitrogen. After the temperature of the solution had been increased to 175° C., a mixed solution of 1,684.8 parts of styrene, 475.2 parts of n-butyl acrylate, 78.0 parts of di-t-butyl peroxide, and 455 parts of xylene was dropped to the solution over 3 hours, and polymerization was performed by holding the mixture at the temperature for 30 minutes. Next, desolvation was performed. Thus, a wax dispersant 1 was obtained. The physical properties of the wax dispersant 1 are shown in Table 1.

<Production of Wax Dispersant 2>

A wax dispersant 2 was produced by the same method as that in the production of the wax dispersant 1 except that a polyethylene wax having a melting point of 107° C. was used instead of the Fischer-Tropsch wax. The physical properties of the resultant wax dispersant 2 are shown in Table 1.

<Production of Wax Dispersant 3>

A wax dispersant 3 was produced by the same method as that in the production of the wax dispersant 1 except that a microcrystalline wax having a melting point of 75° C. was used instead of the Fischer-Tropsch wax. The physical properties of the resultant wax dispersant 3 are shown in Table 1.

<Production of Wax Dispersant 4>

A wax dispersant 4 was obtained by exactly the same method as that in the production of the wax dispersant 1 except that the amount of the Fischer-Tropsch wax was changed to 24.0 parts, the amount of styrene was changed to 1,853.3 parts, and the amount of n-butyl acrylate was changed to 522.7 parts. The physical properties of the wax dispersant 4 are shown in Table 1.

<Production of Wax Dispersant 5>3,000.0 Parts of xylene and 1,200.0 parts of a Fischer-Tropsch wax having a melting point of 77° C. were loaded into a reaction vessel with a stirring machine, a temperature gauge, a nitrogen-introducing tube, and a decompression apparatus, and the wax was sufficiently dissolved in xylene, followed by purging with nitrogen. After the temperature of the solution had been increased to 175° C., a mixed solution of 936.0 parts of styrene, 264.0 parts of n-butyl acrylate, 39.0 parts of di-t-butyl peroxide, and 227.5 parts of xylene was dropped to the solution over 3 hours, and polymerization was performed by holding the mixture at the temperature for 30 minutes. Next, desolvation was performed. Thus, a wax dispersant 5 was obtained. The physical properties of the wax dispersant 5 are shown in Table 1.

<Production of Wax Dispersant 6>

A wax dispersant 6 was produced by exactly the same method as that in the production of the wax dispersant 1 except that the amount of the Fischer-Tropsch wax was changed to 19.2 parts, the amount of styrene was changed to 1,857.0 parts, and the amount of n-butyl acrylate was changed to 523.8 parts. The physical properties of the resultant wax dispersant 6 are shown in Table 1.

<Production of Wax Dispersant 7>

3,120.0 Parts of xylene and 1,248.0 parts of a Fischer-Tropsch wax having a melting point of 77° C. were loaded into a reaction vessel with a stirring machine, a temperature gauge, a nitrogen-introducing tube, and a decompression apparatus, and the wax was sufficiently dissolved in xylene, followed by purging with nitrogen. After the temperature of the solution had been increased to 175° C., a mixed solution of 898.6 parts of styrene, 253.4 parts of n-butyl acrylate, 37.5 parts of di-t-butyl peroxide, and 218.8 parts of xylene was dropped to the solution over 3 hours, and polymerization was performed by holding the mixture at the temperature for 30 minutes. Next, desolvation was performed. Thus, a wax dispersant 7 was obtained. The physical properties of the wax dispersant 7 are shown in Table 1.

<Production of Wax Dispersant 8>

600.0 Parts of xylene and 240.0 parts of a Fischer-Tropsch wax having a melting point of 77° C. were loaded into a reaction vessel with a stirring machine, a temperature gauge, a nitrogen-introducing tube, and a decompression apparatus, and the wax was sufficiently dissolved in xylene, followed by purging with nitrogen. After the temperature of the solution had been increased to 175° C., a mixed solution of 2,095.2 parts of styrene, 64.8 parts of acrylonitrile, 78.0 parts of di-t-butyl peroxide, and 455 parts of xylene was dropped to the solution over 3 hours, and polymerization was performed by holding the mixture at the temperature for 30 minutes. Next, desolvation was performed. Thus, a wax dispersant 8 was obtained. The content of acrylonitrile in the vinyl resin segment is 3.0 mass %. The physical properties of the wax dispersant 8 are shown in Table 1.

<Production of Wax Dispersant 9>

600.0 Parts of xylene and 240.0 parts of a Fischer-Tropsch wax having a melting point of 77° C. were loaded into a reaction vessel with a stirring machine, a temperature gauge, a nitrogen-introducing tube, and a decompression apparatus, and the wax was sufficiently dissolved in xylene, followed by purging with nitrogen. After the temperature of the solution had been increased to 175° C., a mixed solution of 1,506.8 parts of styrene, 424.7 parts of n-butyl acrylate, 228.5 parts of acrylonitrile, 78.0 parts of di-t-butyl peroxide, and 455 parts of xylene was dropped to the solution over 3 hours, and polymerization was performed by holding the mixture at the temperature for 30 minutes. Next, desolvation was performed. Thus, a wax dispersant 9 was obtained. The content of acrylonitrile in the vinyl resin segment is 10.6 mass %. The physical properties of the wax dispersant 9 are shown in Table 1.

TABLE 1

| | SP value of vinyl resin segment | SP value of hydrocarbon compound segment | Content of hydrocarbon compound segment (mass %) | Peak top molecular weight |
|---|---|---|---|---|
| Wax dispersant 1 | 9.80 | 8.32 | 10.0 | 5,600 |
| Wax dispersant 2 | 9.80 | 8.20 | 10.0 | 5,290 |
| Wax dispersant 3 | 9.80 | 8.34 | 10.0 | 5,530 |
| Wax dispersant 4 | 9.80 | 8.32 | 1.0 | 5,780 |
| Wax dispersant 5 | 9.80 | 8.32 | 50.0 | 5,150 |
| Wax dispersant 6 | 9.80 | 8.32 | 0.8 | 5,840 |

TABLE 1-continued

| | SP value of vinyl resin segment | SP value of hydrocarbon compound segment | Content of hydrocarbon compound segment (mass %) | Peak top molecular weight |
|---|---|---|---|---|
| Wax dispersant 7 | 9.80 | 8.32 | 52.0 | 5,070 |
| Wax dispersant 8 | 9.95 | 8.32 | 10.0 | 5,500 |
| Wax dispersant 9 | 10.03 | 8.32 | 10.0 | 5,420 |

EXAMPLE 1

<Production of Toner Particles 1>

| | |
|---|---|
| Styrene | 78.0 parts |
| n-Butyl acrylate | 22.0 parts |
| Copper phthalocyanine pigment (Pigment Blue 15:3) | 6.0 parts |
| Aluminum salicylate compound (Bontron E-88: manufactured by Orient Chemical Industries Co., Ltd.) | 0.7 part |
| Polar resin (styrene-2-hydroxyethyl methacrylate-methacrylic acid-methyl methacrylate copolymer (mass ratio of 95:2:2:3), acid value of 10 mgKOH/g, glass transition temperature (Tg) = 80° C., weight-average molecular weight (Mw) = 15,000) | 4.0 parts |
| Fischer-Tropsch wax (HNP-51: manufactured by Nippon Seiro Co., Ltd: melting point of 77° C., SP value: 8.32) | 9.0 parts |
| Wax dispersant 1 | 4.5 parts |

A mixture of polymerizable monomers formed of the foregoing was prepared. Ceramic beads each having a diameter of 15 mm were loaded into the mixture, and the whole was dispersed with a wet attritor (manufactured by Nippon Coke & Engineering Co., Ltd.) for 2 hours to provide a polymerizable monomer composition 1.

Meanwhile, 6.3 parts of sodium phosphate ($Na_3PO_4$) was loaded into 414.0 parts of ion-exchanged water, and the mixture was warmed to 60° C. while being stirred with CLEARMIX (manufactured by M Technique Co., Ltd.). After that, an aqueous solution of calcium chloride ($CaCl_2$) obtained by dissolving 3.6 parts of calcium chloride in 25.5 parts of ion-exchanged water was added to the mixture, and the whole was further continuously stirred to prepare an aqueous medium containing a dispersion stabilizer formed of tricalcium phosphate ($Ca_3(PO_4)_2$).

10.0 Parts of t-butylperoxy pivalate serving as a polymerization initiator was added to the polymerizable monomer composition 1, and the mixture was loaded into the aqueous dispersion medium. A granulation step was performed with the CLEARMIX for 10 minutes while its number of revolutions was maintained at 15,000 revolutions/min. After that, polymerization was performed for 8 hours by holding the resultant at 70° C. while stirring the resultant in a stirring tank with a general stirring machine. Thus, a toner particle dispersion liquid 1 was obtained.

After the toner particle dispersion liquid 1 had been cooled, hydrochloric acid was added to the liquid to adjust its pH to 1.4 or less, and a dispersion stabilizer was dissolved in the mixture. The solution was filtered, washed, and dried to provide toner particles 1. The physical properties of the toner particles 1 are shown in Table 2. The SP value of a styrene acrylic resin serving as a binder resin in each of the toner particles 1 is 9.8.

EXAMPLE 2

<Production of Toner Particles 2>

Toner particles 2 were produced by the same method as that in Example 1 except that the addition amount of the wax dispersant 1 was changed to 17.1 parts. The physical properties of the resultant toner particles 2 are shown in Table 2.

EXAMPLE 3

<Production of Toner Particles 3>

Toner particles 3 were produced by the same method as that in Example 1 except that the addition amount of the wax dispersant 1 was changed to 0.9 part. The physical properties of the resultant toner particles 3 are shown in Table 2.

EXAMPLE 4

<Production of Toner Particles 4>

Toner particles 4 were produced by the same method as that in Example 1 except that the addition amount of the wax dispersant 1 was changed to 18.9 parts. The physical properties of the resultant toner particles 4 are shown in Table 2.

EXAMPLE 5

<Production of Toner Particles 5>

Toner particles 5 were produced by the same method as that in Example 1 except that the addition amount of the wax dispersant 1 was changed to 0.72 part. The physical properties of the resultant toner particles 5 are shown in Table 2.

EXAMPLE 6

<Production of Toner Particles 6>

Toner particles 6 were produced by the same method as that in Example 1 except that the wax dispersant 1 was changed to the wax dispersant 2. The physical properties of the resultant toner particles 6 are shown in Table 2.

EXAMPLE 7

<Production of Toner Particles 7>

Toner particles 7 were produced by the same method as that in Example 1 except that the wax dispersant 1 was changed to the wax dispersant 3. The physical properties of the resultant toner particles 7 are shown in Table 2.

EXAMPLE 8

<Production of Toner Particles 8>

Toner particles 8 were produced by the same method as that in Example 1 except that the wax dispersant 1 was changed to the wax dispersant 4. The physical properties of the resultant toner particles 8 are shown in Table 2.

EXAMPLE 9

<Production of Toner Particles 9>

Toner particles 9 were produced by the same method as that in Example 1 except that the wax dispersant 1 was changed to the wax dispersant 5. The physical properties of the resultant toner particles 9 are shown in Table 2.

EXAMPLE 10

<Production of Toner Particles 10>

Toner particles 10 were produced by the same method as that in Example 1 except that the wax dispersant 1 was changed to the wax dispersant 6. The physical properties of the resultant toner particles 10 are shown in Table 2.

EXAMPLE 11

<Production of Toner Particles 11>

Toner particles 11 were produced by the same method as that in Example 1 except that the wax dispersant 1 was changed to the wax dispersant 7. The physical properties of the resultant toner particles 11 are shown in Table 2.

EXAMPLE 12

<Production of Toner Particles 12>

The following materials were loaded into a reaction vessel with a reflux condenser, a stirring machine, and a nitrogen-introducing tube under a nitrogen atmosphere.

| | |
|---|---|
| Toluene | 100.0 parts |
| Styrene | 78.0 parts |
| n-Butyl acrylate | 22.0 parts |
| t-Butylperoxy pivalate | 3.0 parts |

The contents in the vessel were stirred at 200 revolutions/min, and were heated to 70° C. and stirred for 10 hours to provide a binder resin dissolved liquid 1.

| | |
|---|---|
| Binder resin dissolved liquid 1 | 160.0 parts |
| Fischer-Tropsch wax (HNP-51: manufactured by Nippon Seiro Co., Ltd: melting point of 77° C., SP value: 8.32) | 7.2 parts |
| Copper phthalocyanine pigment (Pigment Blue 15:3) | 4.8 parts |
| Aluminum salicylate compound (Bontron E-88: manufactured by Orient Chemical Industries Co., Ltd.) | 0.6 part |
| Wax dispersant 1 | 3.6 parts |

Then, the foregoing components were mixed and dispersed for 10 hours using a wet attritor with 15-millimeter ceramic beads (manufactured by Nippon Coke & Engineering Co., Ltd.) to provide a resin composition dissolved liquid 12.

Meanwhile, 6.3 parts of sodium phosphate ($Na_3PO_4$) was loaded into 414.0 parts of ion-exchanged water, and the mixture was warmed to 60° C. while being stirred with CLEARMIX (manufactured by M Technique Co., Ltd.). After that, an aqueous solution of calcium chloride ($CaCl_2$) obtained by dissolving 3.6 parts of calcium chloride in 25.5 parts of ion-exchanged water was added to the mixture, and the whole was further continuously stirred to prepare an aqueous medium containing a dispersion stabilizer formed of tricalcium phosphate ($Ca_3(PO_4)_2$).

The resin composition dissolved liquid 12 was loaded into the aqueous dispersion medium, and a granulation step was performed with the CLEARMIX for 10 minutes while its number of revolutions was maintained at 15,000 revolutions/min. Thus, a resin composition dispersion liquid 12 was obtained.

Toluene in the resin composition dispersion liquid 12 was removed by increasing the temperature of the resin composition dispersion liquid 12 to 95° C. and stirring the liquid for 120 minutes. Thus, a toner particle dispersion liquid 12 was obtained.

After the toner particle dispersion liquid 12 had been cooled, hydrochloric acid was added to the liquid to adjust its pH to 1.4 or less, and a dispersion stabilizer was dissolved in the mixture. The solution was filtered, washed, and dried to provide toner particles 12. The physical properties of the resultant toner particles 12 are shown in Table 2. The SP value of a styrene acrylic resin serving as a binder resin in each of the toner particles 12 is 9.8.

EXAMPLE 13

<Production of Toner Particles 13>

Toner particles 13 were produced by the same method as that in Example 1 except that the wax dispersant 1 was changed to the wax dispersant 8. The physical properties of the resultant toner particles 13 are shown in Table 2.

COMPARATIVE EXAMPLE 1

<Production of Toner Particles 14>

Toner particles 14 were produced by the same method as that in Example 1 except that the wax dispersant 1 was changed to the wax dispersant 9. The physical properties of the resultant toner particles 14 are shown in Table 2.

COMPARATIVE EXAMPLE 2

<Production of Toner Particles 15>

Toner particles 15 were produced by the same method as that in Example 1 except that the wax dispersant 1 was not used. The physical properties of the resultant toner particles 15 are shown in Table 2.

TABLE 2

| | Weight-average particle diameter (μm) | SP value \|A-C\| | \|B-D\| | C-D | Wb/Wa |
|---|---|---|---|---|---|
| Toner particles 1 | 5.9 | 0 | 0 | 1.48 | 0.5 |
| Toner particles 2 | 6.1 | 0 | 0 | 1.48 | 1.9 |
| Toner particles 3 | 5.8 | 0 | 0 | 1.48 | 0.1 |
| Toner particles 4 | 6.0 | 0 | 0 | 1.48 | 2.1 |
| Toner particles 5 | 5.6 | 0 | 0 | 1.48 | 0.08 |
| Toner particles 6 | 5.8 | 0 | 0.12 | 1.60 | 0.5 |
| Toner particles 7 | 6.0 | 0 | 0.02 | 1.46 | 0.5 |
| Toner particles 8 | 5.7 | 0 | 0 | 1.48 | 0.5 |
| Toner particles 9 | 5.9 | 0 | 0 | 1.48 | 0.5 |
| Toner particles 10 | 5.6 | 0 | 0 | 1.48 | 0.5 |
| Toner particles 11 | 6.2 | 0 | 0 | 1.48 | 0.5 |
| Toner particles 12 | 5.8 | 0 | 0 | 1.48 | 0.5 |
| Toner particles 13 | 5.7 | 0.15 | 0 | 1.63 | 0.5 |
| Toner particles 14 | 5.9 | 0.23 | 0 | 1.71 | 0.5 |
| Toner particles 15 | 5.8 | — | — | — | 0 |

<Production of Respective Toners>

A toner was obtained by: adding 1.0 part of silica fine particles having a number-average particle diameter of primary particles of 40 nm to 100.0 parts of each of the toner particles obtained in Examples 1 to 13 and Comparative Examples 1 and 2; and mixing the contents with FM Mixer (manufactured by Nippon Coke & Engineering Co., Ltd.).

Performance evaluations were performed for each of the resultant toners in accordance with the following methods.

[Dispersibility of Wax]

The dispersibility of a wax in a toner particle was evaluated as described below. A section of the toner particle was observed with a transmission electron microscope, the average circle-equivalent diameter of the sectional areas of domains formed by the wax was measured, and the average of ten arbitrarily selected toner particles was used in the evaluation. In detail, the toner particles were embedded in a visible light-curable embedding resin (D-800, manufactured by Nisshin EM Corporation), cut with an ultrasonic ultramicrotome (EM5, manufactured by Leica Microsystems) to have a thickness of 60 nm, and subjected to Ru staining with a vacuum staining apparatus (manufactured by Filgen, Inc.). After that, the resultant was observed with a transmission electron microscope (H-7500, manufactured by Hitachi High-Technologies Corporation) at an acceleration voltage of 120 kV. Ten toner particles each having a particle diameter within ±2.0 μm from the weight-average particle diameter of all toner particles were selected as toner particles to be observed, and were photographed.

Evaluation criteria for the dispersibility of the wax are as described below. A smaller average circle-equivalent diameter of the wax domains means that the dispersibility of the wax is better.

A: The average circle-equivalent diameter of the wax domains is less than 200 nm.

B: The average circle-equivalent diameter of the wax domains is 200 nm or more and less than 500 nm.

C: The average circle-equivalent diameter of the wax domains is 500 nm or more and less than 1,000 nm.

D: The average circle-equivalent diameter of the wax domains is 1,000 nm or more and less than 1,500 nm.

E: The average circle-equivalent diameter of the wax domains is 1,500 nm or more.

[Low-temperature Fixability]

A color laser printer (HP Color LaserJet 3525dn, manufactured by Hewlett-Packard Company) from which a fixing unit had been removed was prepared. A toner was removed from its cyan cartridge, and a toner to be evaluated was loaded into the cartridge instead. Next, an unfixed toner image (0.9 mg/cm$^2$) measuring 2.0 cm in a longitudinal direction by 15.0 cm in a lateral direction was formed on image-receiving paper (HP Laser JET90, manufactured by Hewlett-Packard Company, 90 g/m$^2$) with the loaded toner in a portion distant from the upper end portion of the paper with respect to a sheet-feeding direction by 1.0 cm. Next, the removed fixing unit was reconstructed so that its fixation temperature and process speed could be regulated, and the fixation test of the unfixed image was performed with the unit.

First, under a normal-temperature and normal-humidity environment (23° C., 60% RH), the process speed and a fixing linear pressure were set to 380 mm/s and 25.0 kgf, respectively, and the unfixed image was fixed at each temperature while a preset temperature was sequentially increased in increments of 5° C. from an initial temperature of 130° C.

Evaluation criteria for the low-temperature fixability of the toner are as described below. The term "low-temperature side fixation starting point" refers to the lower limit temperature at which a cold offset phenomenon (phenomenon in which part of the toner adheres to the fixing unit) is not observed.

A: The low-temperature side fixation starting point is 145° C. or less (the low-temperature fixability is particularly excellent).

B: The low-temperature side fixation starting point is 150° C. or more and 155° C. or less (the low-temperature fixability is excellent).

C: The low-temperature side fixation starting point is 160° C. or more and 165° C. or less (the low-temperature fixability is satisfactory).

D: The low-temperature side fixation starting point is 170° C. or more and 175° C. or less (the low-temperature fixability is somewhat poor).

E: The low-temperature side fixation starting point is 180° C. or more (the low-temperature fixability is poor).

The results of the performance evaluations of the toners are shown in Table 3.

TABLE 3

| | | Dispersibility of wax | | Low-temperature fixability | |
|---|---|---|---|---|---|
| | | Rank | Average circle-equivalent diameter of wax domains (nm) | Rank | Low-temperature side fixation starting point temperature (° C.) |
| Example 1 | Toner particles 1 | A | 150 | A | 145 |
| Example 2 | Toner particles 2 | B | 320 | B | 150 |
| Example 3 | Toner particles 3 | B | 440 | B | 155 |
| Example 4 | Toner particles 4 | C | 510 | C | 160 |
| Example 5 | Toner particles 5 | C | 650 | C | 165 |
| Example 6 | Toner particles 6 | A | 190 | A | 145 |
| Example 7 | Toner particles 7 | C | 780 | C | 165 |
| Example 8 | Toner particles 8 | B | 390 | B | 155 |
| Example 9 | Toner particles 9 | B | 290 | B | 150 |
| Example 10 | Toner particles 10 | C | 820 | C | 165 |
| Example 11 | Toner particles 11 | C | 540 | C | 160 |
| Example 12 | Toner particles 12 | A | 180 | A | 145 |
| Example 13 | Toner particles 13 | B | 380 | B | 150 |
| Comparative Example 1 | Toner particles 14 | D | 1,230 | D | 170 |
| Comparative Example 2 | Toner particles 15 | E | 1,570 | D | 175 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-168488, filed Aug. 28, 2015, which is hereby incorporated by reference herein in its entirety.

What is claimed is:

1. A toner, comprising a toner particle containing:

a binder resin containing a styrene acrylic resin as a main component;

a colorant;

a hydrocarbon wax; and a wax dispersant comprising a vinyl resin segment and a hydrocarbon compound segment, the vinyl resin segment being a styrene-n-butyl acrylate bipolymer, wherein the binder resin and the wax dispersant satisfy formulae (1) and (2):

$$|A-C|\leq 0.20 \quad (1)$$

$$C-D<1.65 \quad (2)$$

where "A" represents a solubility parameter of the binder resin, "C" represents a solubility parameter of the vinyl resin segment of the wax dispersant, and "D" represents a solubility parameter of the hydrocarbon compound segment of the wax dispersant, and a content of the hydrocarbon compound segment of the wax dispersant is 1 to 50 mass % with respect to a total mass of the wax dispersant.

2. A toner according to claim 1, wherein the hydrocarbon wax and the wax dispersant satisfy formula (3):

$$|B-D|\leq 0.30 \quad (3)$$

where "B" represents a solubility parameter of the hydrocarbon wax.

3. A toner according to claim 1, wherein the hydrocarbon compound segment of the wax dispersant is one of a polyolefin and a paraffin.

4. A toner according to claim 1, wherein Wb/Wa≤2.0 is satisfied when Wa mass % is a content of the hydrocarbon wax in the toner particle and Wb mass % is a content of the wax dispersant therein.

5. A toner according to claim 1, further comprising a vinyl resin segment comprising a methacrylic polymerizable monomer.

6. A method of producing the toner including the toner particle of claim 1, the method comprising:

forming in an aqueous medium a particle of a polymerizable monomer composition containing a polymerizable monomer, the colorant, the hydrocarbon wax, and the wax dispersant; and polymerizing the polymerizable monomer in the particle of the polymerizable monomer composition to produce the binder resin containing the styrene acrylic resin as a main component.

7. A method of producing the toner including the toner particle of claim 1, the method comprising:

forming in an aqueous medium a particle of a resin solution obtained by dissolving or dispersing the binder resin containing the styrene acrylic resin as a main component, the colorant, the hydrocarbon wax, and the wax dispersant in an organic solvent; and removing the organic solvent in the particle of the resin solution.

8. The toner according to claim 1, wherein the content of the hydrocarbon compound segment of the wax dispersant is 1 to 10 mass % with respect to a total mass of the wax dispersant.

9. A toner, comprising a toner particle containing:

a binder resin containing a styrene acrylic resin as a main component;

a colorant;

a hydrocarbon wax; and a wax dispersant comprising a vinyl resin segment and a hydrocarbon compound segment, the vinyl resin segment being a polymer of a composition comprising a styrene monomer and one or more kinds of vinyl-based polymerizable monomers except the styrene monomer, wherein the binder resin and the wax dispersant satisfy formulae (1) and (2):

$$|A-C| \leq 0.20 \quad (1)$$

$$C-D < 1.65 \quad (2)$$

where "A" represents a solubility parameter of the binder resin, "C" represents a solubility parameter of the vinyl resin segment of the wax dispersant, and "D" represents a solubility parameter of the hydrocarbon compound segment of the wax dispersant, a content of the hydrocarbon compound segment of the wax dispersant is 1 to 50 mass % with respect to a total mass of the wax dispersant, the vinyl-based polymerizable monomers except the styrene monomer comprises an acrylonitrile, and a content of the acrylonitrile of the composition in the vinyl resin segment is 5 mass % or less with respect to a total mass of the composition in the vinyl resin segment.

* * * * *